US006340052B1

(12) United States Patent
Uehara

(10) Patent No.: US 6,340,052 B1
(45) Date of Patent: Jan. 22, 2002

(54) HEAT EXCHANGER

(76) Inventor: Haruo Uehara, 1544-119, Ooaza-Kinryu, Kinryu-Machi, Saga-Shi, Saga-Ken (JP)

( * ) Notice: Subject to any disclaimer, the term of this patent is extended or adjusted under 35 U.S.C. 154(b) by 0 days.

(21) Appl. No.: 09/550,291

(22) Filed: Apr. 14, 2000

(30) Foreign Application Priority Data

Apr. 28, 1999 (JP) ..... 11-122778

(51) Int. Cl.[7] ..... F28F 3/00
(52) U.S. Cl. ..... 165/166; 165/164; 165/158
(58) Field of Search ..... 165/165, 166, 165/164, 167, 157, 110, 111, 158

(56) References Cited

U.S. PATENT DOCUMENTS

| | | | | | |
|---|---|---|---|---|---|
| 447,396 | A | * | 3/1891 | Worthington | 165/166 |
| 1,874,360 | A | * | 8/1932 | Ryan | 165/166 |
| 3,168,137 | A | * | 2/1965 | Smith | 165/166 |
| 3,255,816 | A | * | 6/1966 | Rosenblad | 165/166 |
| 3,587,730 | A | * | 6/1971 | Milton | 165/110 |
| 4,157,929 | A | * | 6/1979 | Kubicek | 165/166 |
| 4,293,033 | A | * | 10/1981 | Nasser | 165/166 |
| 4,616,695 | A | * | 10/1986 | Takahashi et al. | 165/166 |
| 4,657,072 | A | * | 4/1987 | Mulock-Bently | 165/153 |
| 4,815,533 | A | * | 3/1989 | Harada et al. | 165/159 |
| 5,224,538 | A | * | 7/1993 | Jacoby | 165/166 |
| 6,076,598 | A | * | 6/2000 | Doi et al. | 165/166 |

* cited by examiner

*Primary Examiner*—Ira S. Lazarus
*Assistant Examiner*—Temell McKinnon
(74) *Attorney, Agent, or Firm*—Ronald P. Kananen; Rader, Fishman & Grauer, PLLC

(57) ABSTRACT

Tubular heat transferring members are disposed in a shell. A kind of fluid passes through the heat transferring members, while the other kind of fluid flows around the heat transferring members in the direction perpendicular to the flowing direction of the former fluid, to make a heat exchange between these fluids through the heat transferring members. No packing member is needed to ease restriction in pressure applied to the fluid, improving the heat exchange efficiency. There is no occurrence of leakage, improving reliability. The opposite end portions of the heat transferring members serve as an inlet to the inside of the heat transferring members and an outlet therefrom and there is no opening formed in the intermediate portion of the heat transferring members without wasting material in a blanking process for the heat transferring members, thus providing an economic effect.

6 Claims, 7 Drawing Sheets

HEAT EXCHANGER

BACKGROUND OF THE INVENTION

1. Field of the Invention

The present invention relates to a heat exchanger for making heat exchange between high temperature fluid and low temperature fluid, and especially to a heat exchanger, which permits to provide economical effects and has a high reliability and safety.

2. Description of the Related Art

In general, a heat exchanger is used as a heat/cooling device, an evaporator or a condenser in a plant of electric generation by temperature difference, steam power, chemistry, food engineering and the like, a refrigerator and a heat pump. Such a heat exchanger can make heat exchange between high temperature fluid and low temperature fluid for the purposes of heating, boiling, evaporating, cooling and condensing fluid.

The conventional heat exchanger may be classified into a shell and tube heat exchanger, a plate type heat exchanger, a spiral type heat exchanger and the like. The plate type heat exchanger is generally used as an evaporator for boiling and evaporating a working fluid having a low temperature by heat of a high temperature fluid and as a condenser for absorbing heat through a low temperature fluid to condense a working fluid having a high temperature in a plant of electric generation by temperature difference, a refrigerator and a heat pump. An example of the conventional plate type heat exchanger used as the evaporator and the condenser is shown in FIGS. 6 and 7. FIG. 6 is an exploded perspective view illustrating essential components of the conventional heat exchanger. FIG. 7 is a schematic descriptive view of the conventional heat exchanger in an assembled condition.

The conventional plate type heat exchanger 100 as shown in FIGS. 6 and 7 is provided with plural pairs of plates 101, 102. In each pair, the plate 101 is placed on the other plate 102. Upper and lower guide rods 105, 106 held between a stationary frame 103 and a support rod 104 support the plural pairs of these plates 101, 102. The plural pairs of the plates 101, 102 are firmly held between the stationary frame 103 and a movable frame 107 that is mounted on the guide rods 105, 106. Two heat exchange passages A, B are formed on the opposite surfaces of each of the plates 101, 102. A heat-exchanger fluid 108 having a high or low temperature flows in the heat exchange passage A and a working fluid 109 flows in the other heat exchange passage B so as to make heat exchange.

The above-mentioned plates 101, 102 having a prescribed shape and a surface condition can be obtained by press-forming a plate-shaped material. Openings "a", "b", "c" and "d" through which the heat-exchanger fluid 108 or the working fluid 109 can pass, are formed at four corners of each of the plates 101, 102. Packing members 111, 112 are placed on the surfaces of the plates 101, 102, respectively, so as to prevent the heat-exchanger fluid 108 and the working fluid 109 from flowing in a mixing condition. The plates 101, 102 have the same shape, but the plates 102 is placed upside down relative to the normal placement of the plate 101.

However, in the conventional heat exchanger having the above-described structure, the heat exchange fluid 108 or the working fluid 109 supplied between the plates 101, 102 in the horizontal direction in FIG. 7 passes through the openings "a", "b", "c" and "d" and turns vertically so as to make a vertical flow between the plates 101, 102, thus flowing in a complicated manner and leading to a large pressure loss. Accordingly, it is necessary to increase a supplying pressure of each of the fluids. However, the fluid-tightness of the heat exchange passages A, B can not be obtained unless the packing members 111, 112 are firmly pressed against the plates 101, 102. In view of this fact, it is impossible to increase the pressure of the heat-exchanger fluid 108 or the working fluid 109 over the prescribed limit so as to prevent the leakage due to insufficient pressing of the packing members 111, 112. A number and size of the plates 101, 102 are also restricted, thus causing a problem. In addition, when ammonia or a mixture of ammonia and water is used as the working fluid 109, a sufficient safety cannot be obtained due to the use of the packing members 111, 112.

In order to solve the above-mentioned problems, there have conventionally been developed for practical use plate type heat exchangers as the products of ALFA RAVAL Co. Ltd., in which the plates that have been obtained by press-forming the material plate into a prescribed shape were joined with each other by a brazing method without using packing members to form an integral body, while forming heat exchange passages on the opposite surfaces of each plate, and there is no need for movable frame and stationary frame. However, a specific tool is required to join the plates with each other, leading to complicated manufacturing steps and requiring a high manufacturing cost.

When the conventional heat exchanger has a heat transferring face on which irregular portions are formed in order to improve the heat transferring effect and discharge fluid easily, which is produced through condensation, a remarkable pressure loss occurs. When the pressing accuracy for preparation of the plates 101, 102 is not so high, the plates 101, 102 come into contact with each other at their portions, which should not come into contact with each other, so that the pressing condition of the plates 101, 102 changes to impart an adverse influence to the close contact of the packing members 111, 112.

The ratio of area of the openings "a", "b", "c" and "d" to the plates 101, 102 is relatively high and these openings are formed by a removing process such as a punching step. Accordingly, a blanking process for the plates 101, 102 is carried out to form blanks having such waste portions. When the plates are to be used especially for the electric generation by temperature difference in seawater, they are formed of materials such as expensive titanium or special alloy in view of corrosion resistance, thus leading to occurrence of uneconomic problems in material costs. Japanese Patent Provisional Publication No. S60-80082 discloses the other plate type heat exchanger, in which the above-mentioned problems are taken into consideration. The other plate type heat exchanger has a structure in which a number of passage portions that are obtained by forming openings on the plates is limited to two on the upper and lower sides so as to solve the uneconomic problems in material costs and extremely increase the ratio of area of the heat transferring face to the plate. However, the other plate type heat exchanger has the passage portions, resulting in the occurrence of the uneconomic problems in costs of the material as used. In addition, the passage portions of the plate do not contribute to the heat exchange and it is therefore necessary to use the plate, which is larger than the essential area of the heat transferring face.

SUMMARY OF THE INVENTION

An object of the present invention, which was made in order to solve the above-described problems, is therefore to provide a heat exchanger in which the supporting structure of the heat transferring face is improved to permit the non-use of packing members and the release from the restriction due to the use of them, the heat transferring face has a simple shape to reduce the manufacturing cost and reliability and safety are improved.

In order to attain the aforementioned object, the heat exchanger of the present invention for making heat exchange between high temperature fluid and low temperature fluid, said apparatus comprises:

a shell having a box-shape, an inside of which is divided into at least three zones disposed in a prescribed direction by at least two parallel partition walls; and a plurality of tubular heat transferring members, said heat transferring members comprising a plurality of tubular bodies each having opposite open ends and two surfaces being opposite in parallel to each other at a prescribed distance, said tubular bodies being disposed in parallel with each other in an intermediate zone of said zones of said shell, which locates between adjacent both zones different from said intermediate zone, so that a central axis of each of said tubular bodies coincide with a prescribed direction and said surfaces of said tubular bodies are opposite in parallel to each other, said tubular bodies passing through said at least two parallel partition walls so that the opposite open ends of each of said tubular bodies locate in said adjacent both zones to said intermediate zone, respectively, and an inside of each of said tubular bodies being isolated from said intermediate zone;

heat exchange being made through said tubular heat transferring members serving as heat transferring faces by supplying any one of the high temperature fluid and the low temperature fluid to any one of said adjacent both zones to said intermediate zone of said shell under a prescribed pressure, to cause said any one of the high temperature fluid and the low temperature fluid to pass through said tubular heat transferring members, and discharging said any one of the high temperature fluid and the low temperature fluid from the other of said adjacent both zones to said intermediate zone, while supplying the other of the high temperature fluid and the low temperature fluid to said intermediate zone from a side surface of said shell to cause it to flow between said tubular heat transferring members in a direction perpendicular to an axial direction of said tubular heat transferring members.

The heat exchanger of the present invention has a structure that the tubular heat transferring members serving as the heat transferring faces for making heat exchange are disposed in the box-shaped shell, any one of the high temperature fluid and the low temperature fluid passes through the inside of the tubular heat transferring members and the other of the high temperature fluid and the low temperature fluid passes through the region surrounding the tubular heat transferring members in a direction perpendicular to the above-mentioned any one of them so that the heat exchange can be made between the high temperature fluid and the low temperature fluid through the tubular heat transferring members. As a result, it is unnecessary to use any packing member in order to ensure the gap between the heat transferring faces. In addition, it is possible to ease restriction in pressure applied to fluid so that the fluid having a high temperature and a high pressure can be used. It is also possible to dispose a large number of heat transferring faces and increase the size thereof so as to improve the heat exchange efficiency. There is no occurrence of leakage at the packing members, thus improving remarkably the reliability. The opposite end portions of the tubular heat transferring members serve as an inlet to the inside of the tubular heat transferring members and an outlet therefrom and there is no opening formed in the intermediate portion of the tubular heat transferring members without wasting material in a blanking process for the tubular heat transferring members. It is therefore possible to provide economic effects and simplify the flow line of the fluid to reduce pressure loss.

In the heat exchanger of the present invention, the tubular heat transferring members may have on their surfaces a prescribed pattern of irregularity as an occasion demands. When the tubular heat transferring members have the prescribed pattern of irregularity in this manner in the present invention, it is possible to ensure a large area of the heat transferring faces. In addition, it is possible to cause evaporation or condensation more effectively when the heat exchanger is used as an evaporator or a condenser.

In the heat exchanger of the present invention, the tubular heat transferring members may have a porous inner surface as an occasion demands. When the tubular heat transferring members have a porous inner surface so as to increase, in the use of the heat exchanger as the evaporator, bubble generation cores of the fluid, which comes into contact with the inner surface of the tubular heat transferring members to be heated and to facilitate removal of the bubble generation cores, which have grown to a prescribed size, from the inner surface of the tubular heat transferring members, it is possible to facilitate the generation of bubbles so as to cause evaporation more effectively, thus improving the heat exchange efficiency. In addition, when the heat exchanger is used as the condenser, the porous inner surface of the tubular heat transferring members makes it possible to increase the area for the heat exchange, thus improving the condensation efficiency.

DETAILED DESCRIPTION OF THE PREFERRED EMBODIMENTS

Figure 1:
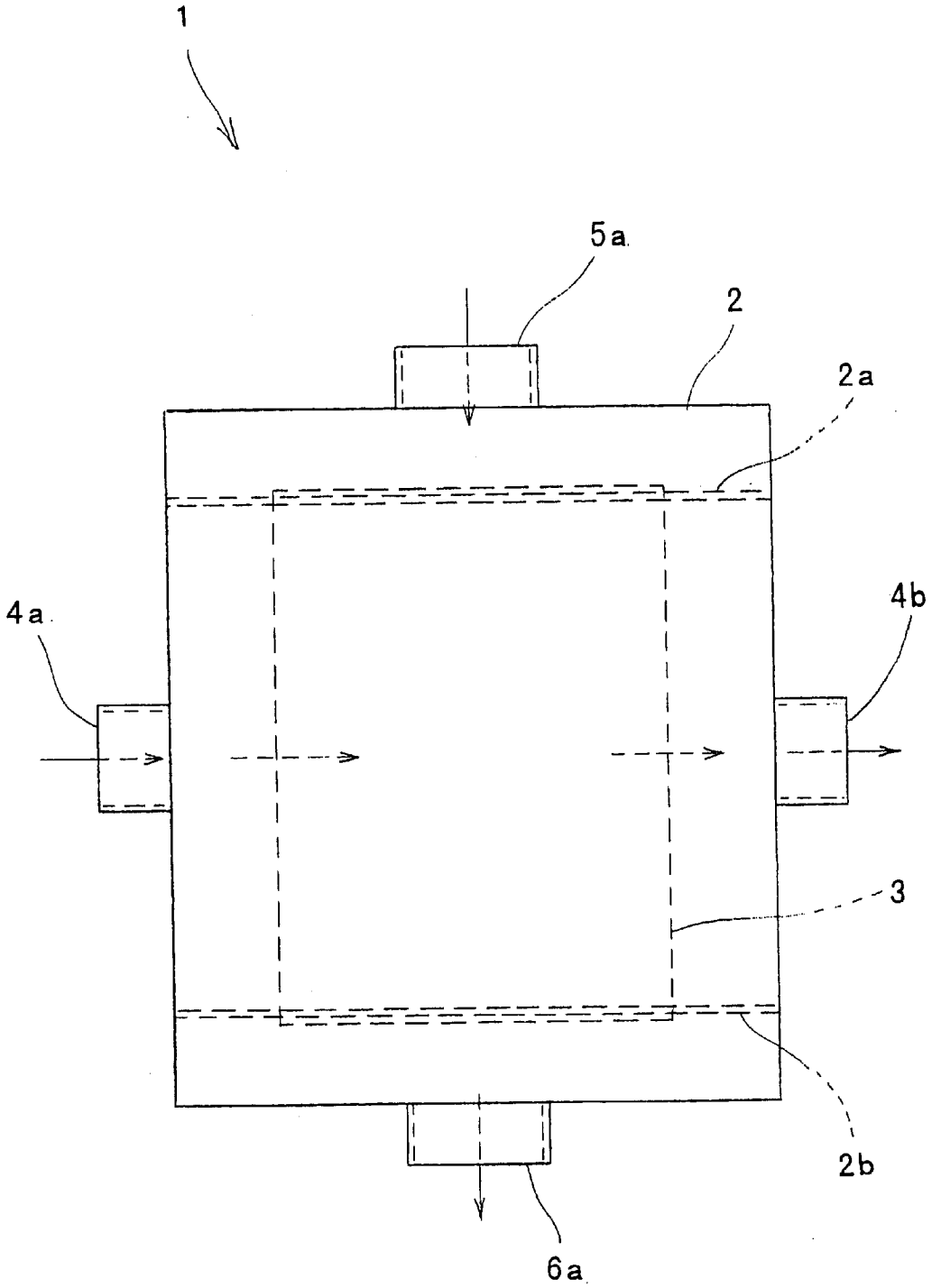
FIG. 1 is a side view illustrating a heat exchanger of the embodiment of the present invention in its installation state.

Now, an embodiment of a heat exchanger of the present invention will be described in detail below with reference to FIGS. 1 to 3. FIG. 1 is a side view illustrating the heat exchanger of the embodiment of the present invention in its installation state, FIG. 2 is a longitudinal cross-sectional view of the heat exchanger of the embodiment of the present invention and FIG. 3 is a perspective view of the essential part of the heat exchanger of the embodiment of the present invention, which has a cross-sectional portion.

Figure 2:
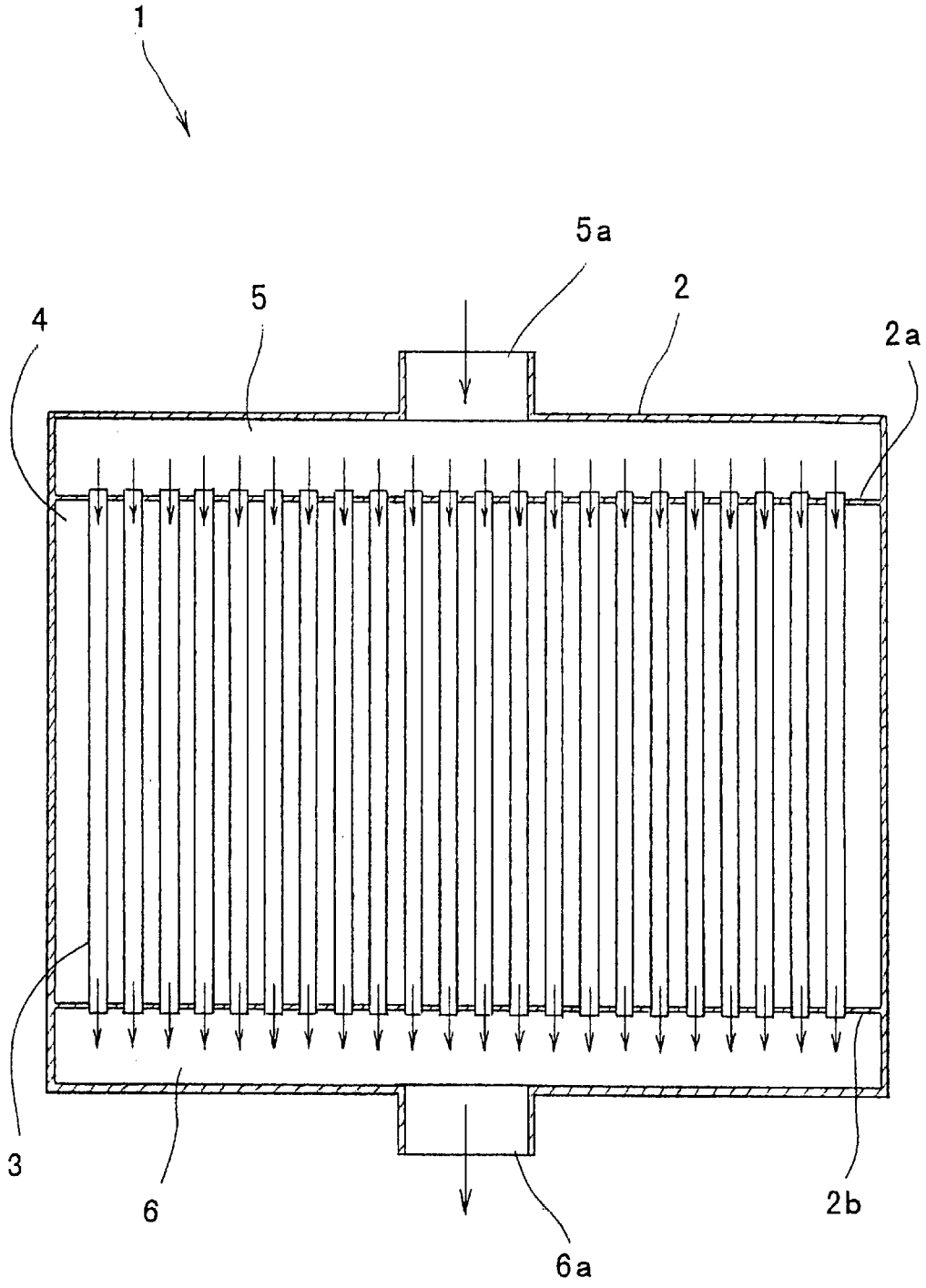
FIG. 2 is a longitudinal cross-sectional view of the heat exchanger of the embodiment of the present invention.
Figure 3:
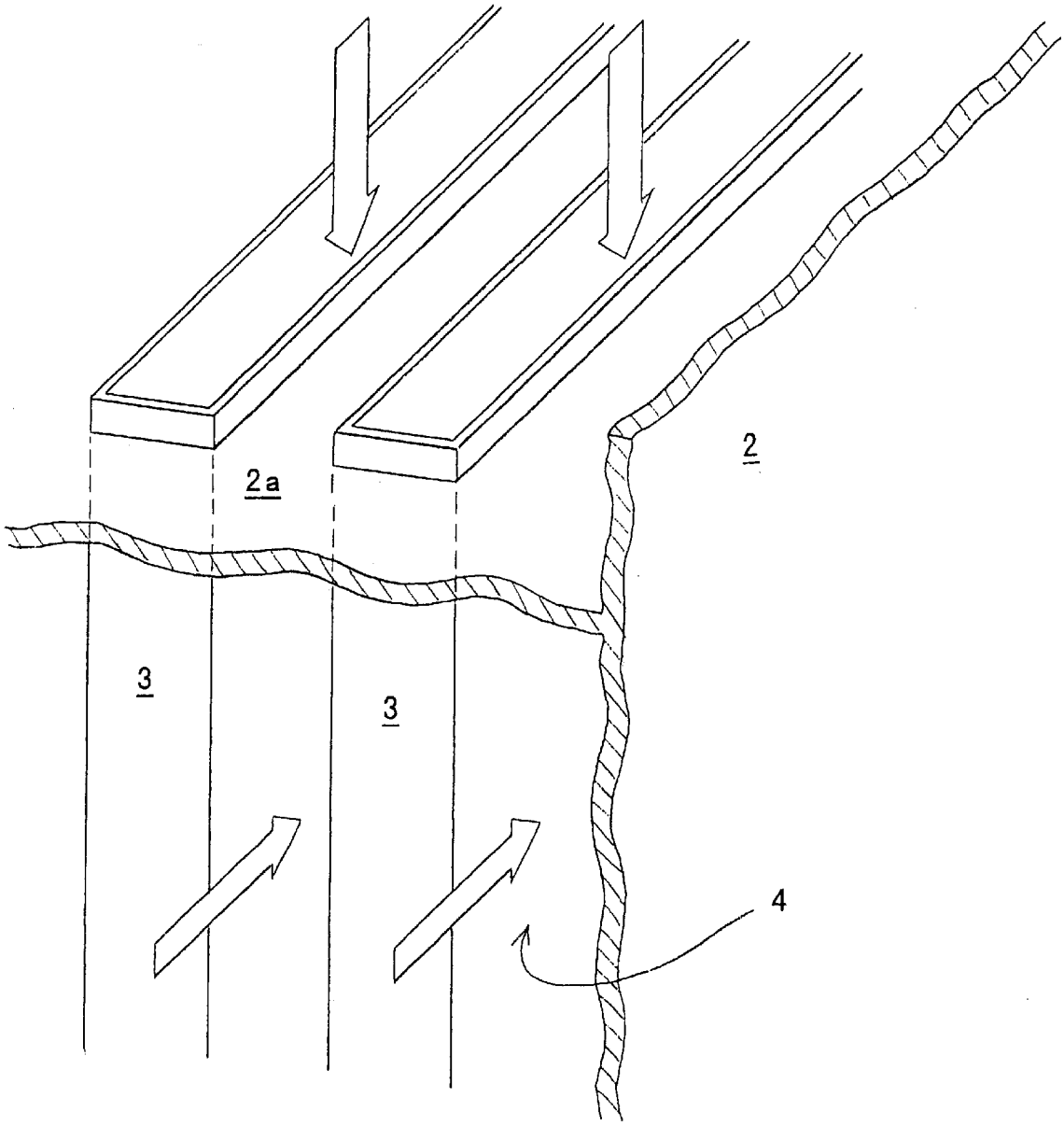
FIG. 3 is a perspective view of the essential part of the heat exchanger of the embodiment of the present invention, which has a cross-sectional portion.

As shown in FIGS. 1 to 3, the heat exchanger 1 of the embodiment of the present invention is composed of a shell 2 having a box-shape and of a plurality of tubular heat transferring members 3. The inside of the shell 2 is divided into three zones disposed in the vertical direction by two parallel partition walls 2*a*, 2*b*. The tubular heat transferring members 3 comprise a plurality of tubular bodies each having opposite open ends and two surfaces being opposite in parallel to each other at a prescribed distance. The tubular bodies are disposed in parallel with each other in an intermediate zone 4 of the three zones of the shell 2, so that the central axis of each of the tubular bodies coincide with the vertical direction and the surfaces of the tubular bodies are opposite in parallel to each other. The tubular bodies pass through the parallel partition walls 2*a*, 2*b* so that the opposite open ends of each of the tubular bodies locate in the upper zone 5 and the lower zone 6, which are adjacent to the intermediate zone 4, respectively, and the inside of each of the tubular bodies is isolated from the intermediate zone 4.

The shell 2 is made of a metallic body having a rectangular box-shape. The shell 2 has the partition wall 2*a* provided in a position, which is apart from the upper end by a prescribed distance, as well as the partition wall 2*b* provided in the other position, which is apart from the lower end by a prescribed distance. The inside of the shell 2 is divided into the three zones, i.e., the upper zone, the intermediate zone 4 and the lower zone 6 in this manner. The box-shaped body has at its upper portion an upper inlet-outlet opening 5*a* through which a working fluid having a prescribed pressure is supplied to the upper zone 5 or discharged therefrom. The box-shaped body has at its lower portion a lower inlet-outlet opening 6*a* through which the working fluid is discharged from the lower zone or supplied thereto. The shell 2 has a supply port 4*a* through which a heat-exchanger fluid is supplied, on the one side face of the shell 2, which faces the intermediate zone 4. The shell 2 also has a discharge port 4*b* through which the heat-exchanger fluid is discharged, on the opposite side face of the shell 2, which faces the intermediate zone 4.

The tubular heat transferring members 3 are made of metallic tubular bodies, which have a large aspect ratio and a rectangular cross-section. The tubular heat transferring members 3 locate vertically in the intermediate zone 4 so that their opposite end portions pass through the partition walls 2*a*, 2*b*, respectively. The tubular heat transferring members 3 are fixed, at their portions passing through the partition walls 2*a*, 2*b*, to the partition walls 2*a*, 2*b* so as to come into close contact with the partition walls 2*a*, 2*b* without forming any gap. The close contact of the tubular heat transferring members 3 with the partition walls 2*a*, 2*b* causes the upper zone 5 and the lower zone 6 to be isolated from the intermediate zone 4. The tubular heat transferring members 3 have on their surfaces a prescribed pattern of irregularity so as to increase the total area of the heat transferring faces and improve the strength.

Description will be given below of a heat exchange action of the heat exchanger having the above-described structure, which is used as a condenser.

When the heat exchanger is used as the condenser, a gaseous phase-working fluid is supplied under a prescribed pressure through the upper inlet-outlet opening 5*a* to the upper zone 5 of the shell 2 to cause the working fluid to flow in the tubular heat transferring members 3 in the downward direction. A low temperature fluid is continuously supplied through the supply port 4*a* formed on the one side surface of the shell 2 to the intermediate zone 4, while discharging the low temperature fluid from the discharge port 4*b* formed on the opposite side surface of the shell 2. The low temperature fluid flows between the tubular heat transferring members 3 in the direction perpendicular to the flowing direction of the working fluid in the tubular heat transferring members 3 so as to make a heat exchange utilizing them as the heat transferring faces. The working fluid comes into contact with the inner surface of the tubular heat transferring members 3 in the inside thereof to emit heat through the tubular heat transferring members 3 to the low temperature fluid, which flows outside them, so as to condense on the inner surface of the tubular heat transferring members 3 to become a liquid phase. The working fluid liquefied in this manner flows immediately downward along the inner surface of the tubular heat transferring members 3. The working fluid drops from the tubular heat transferring members 3 into the lower zone 6 and is discharged from the lower inlet-outlet opening 6*a*.

The heat exchanger of the embodiment of the present invention has a structure that the tubular heat transferring members 3, which are composed of the tubular bodies serving as the heat transferring faces for the heat exchange are disposed in the shell 2, and the working fluid flows in the tubular heat transferring members 3 while the low temperature heat-exchanger fluid or the high temperature heat-exchanger fluid flows in the intermediate zone 4 surrounding the tubular heat transferring members 3 so as to make a heat exchange through the heat transferring members 3. Accordingly, it is possible to ensure the large area of the heat transferring faces in the same manner as the conventional plate type heat exchanger. It is unnecessary to use any members for ensuring gaps between the heat transferring faces and to release the restriction on the pressure, which is applied to the fluid, thus making it possible to use the fluid having a high temperature and a high pressure (for example, a pressure of up to about 200 atmospheric pressure). In addition, it is possible to make a parallel arrangement of the heat transferring faces in larger numbers than the conventional heat exchanger and to use the enlarged heat transferring faces, thus improving the heat exchange efficiency. It is also possible to solve a problem of leakage, which may occur in a place where the packing members are provided, thus improving remarkably reliability and safety. The opposite ends of each of the tubular heat transferring members 3 serve as an inlet and an outlet, which communicate with its inside, respectively. As a result, it is possible to form each of the tubular heat transferring members 3 into the simple tubular shape so as to prevent the production of waste portions in the blanking step for the tubular heat transferring members 3. Accordingly, the manufacturing cost can be reduced. The flow line of the fluid can also be simplified, thus reducing pressure loss.

In the embodiment of the heat exchanger of the present invention, the tubular heat transferring members 3 are composed of the tubular bodies each of which is made of a single metallic plate so as to form the simple rectangular cross section. There may be adopted a structure that two plates are joined to each other through a spacer into an integral body to form the tubular body having the rectangular cross section. With respect to the structure for supporting the tubular heat transferring members 3 in parallel with each other, a spacer is disposed between the adjacent two tubular heat transferring members 3, which locate in parallel with each other, and the spacer and the tubular heat transferring members 3 are adhered or welded to each other to form an integral body, except the adoption of the supporting structure utilizing the partition walls 2*a*, 2*b*. According to such a structure, it is possible to maintain properly the gap between the parallel opposing surfaces of each of the tubular heat transferring members 3 as well as the gap between the adjacent two tubular heat transferring members 3 so as to ensure a sufficient heat transferring area relative to a unit volume in the same manner as the conventional plate type heat exchanger.

In the heat exchanger of the embodiment of the present invention, the tubular heat transferring members 3 have on their surfaces a prescribed pattern of irregularity. In addition to such a structure, the tubular heat transferring members 3 may have an porous inner surface over the entirety. In this case, it is possible to increase, in the use of the heat exchanger as the evaporator, bubble generation cores of the working fluid, which is in the liquid phase on the inner surface of the tubular heat transferring members 3, and to facilitate removal of the bubble generation cores, which have grown to a prescribed size, from the inner surface of the tubular heat transferring members 3. It is therefore possible to facilitate the generation of bubbles so as to cause evaporation more effectively, thus improving the heat exchange efficiency.

In the heat exchanger of the embodiment of the present invention, the tubular heat transferring members 3 are located in parallel with each other in the shell 2 having the simple rectangular cross section. The tubular heat transferring members 3 may locate in the shell 2 in series in the flowing direction of the heat-exchanger fluid or in the form of zigzag. In this case, it is possible to bring more effectively the heat-exchanger fluid passing through the shell 2 into contact with the surfaces of the tubular heat transferring members 3, so as to make a stable heat exchange between the heat-exchanger fluid and the working fluid, thus improving the heat exchange efficiency.

In the heat exchanger of the embodiment of the present invention, the shell 2 has the supply port 4*a* through which the heat-exchanger fluid is supplied, on the one side face of the shell 2, which faces the intermediate zone 4, and the discharge port 4*b* through which the heat-exchanger fluid is discharged, on a prescribed portion of the opposite side face of the shell 2, which faces the intermediate zone 4. The supply port 4*a* and the discharge port 4*b* may be formed on any one of the side faces of the shell 2 so long as the flowing direction of the liquid from the supply port 4*a* to the discharge port 4*b* is perpendicular to the axial direction of the tubular heat transferring members 3. For example, the supply port 4*a* and the discharge port 4*b* may be formed respectively on the upper and lower portions of the same side face, which faces the intermediate zone 4.

Figure 4:
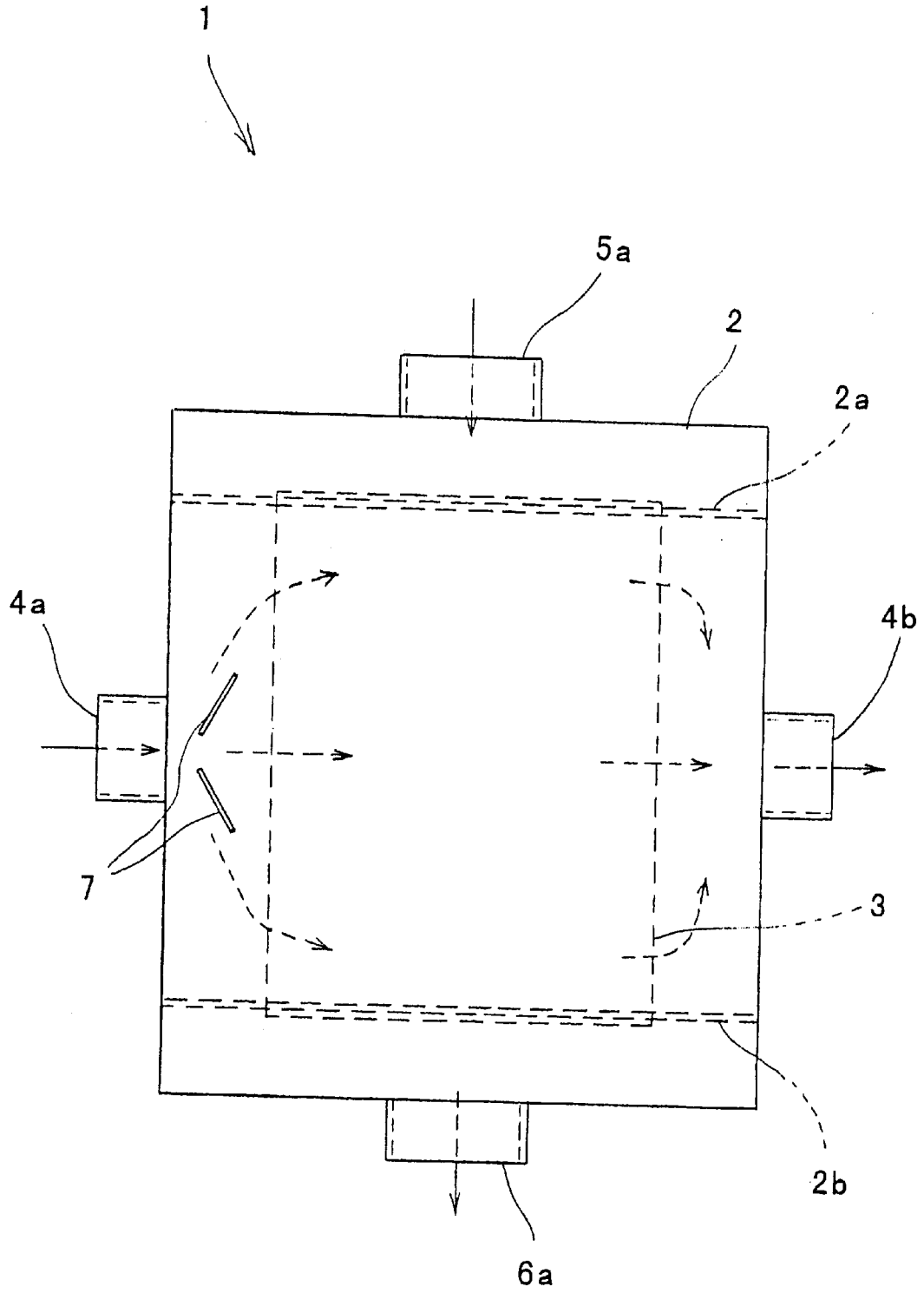
FIG. 4 is a side view illustrating the heat exchanger of another embodiment of the present invention in its installation state.

In the heat exchanger of the embodiment of the present invention, there is no obstacles between the supply port 4*a* formed on the side face of the shell 2 and each of the tubular heat transferring members 3 so that the heat-exchanger fluid, which is supplied from the supply port 4*a* into the intermediate zone 4, can pass smoothly through the tubular heat transferring members 3. A guide plate 7 is provided at a prescribed position between the supply port 4*a* and the tubular heat transferring member 3 in the intermediate zone 4 as shown in FIG. 4, to divide the flow of the heat-exchanger fluid that is supplied from the supply port 4*a* in the upper and lower directions. In this case, it is possible to cause the heat-exchanger fluid uniformly in the upper and lower directions between the supply port 4*a* and the tubular heat transferring member 3 without causing a drift.

Figure 5:
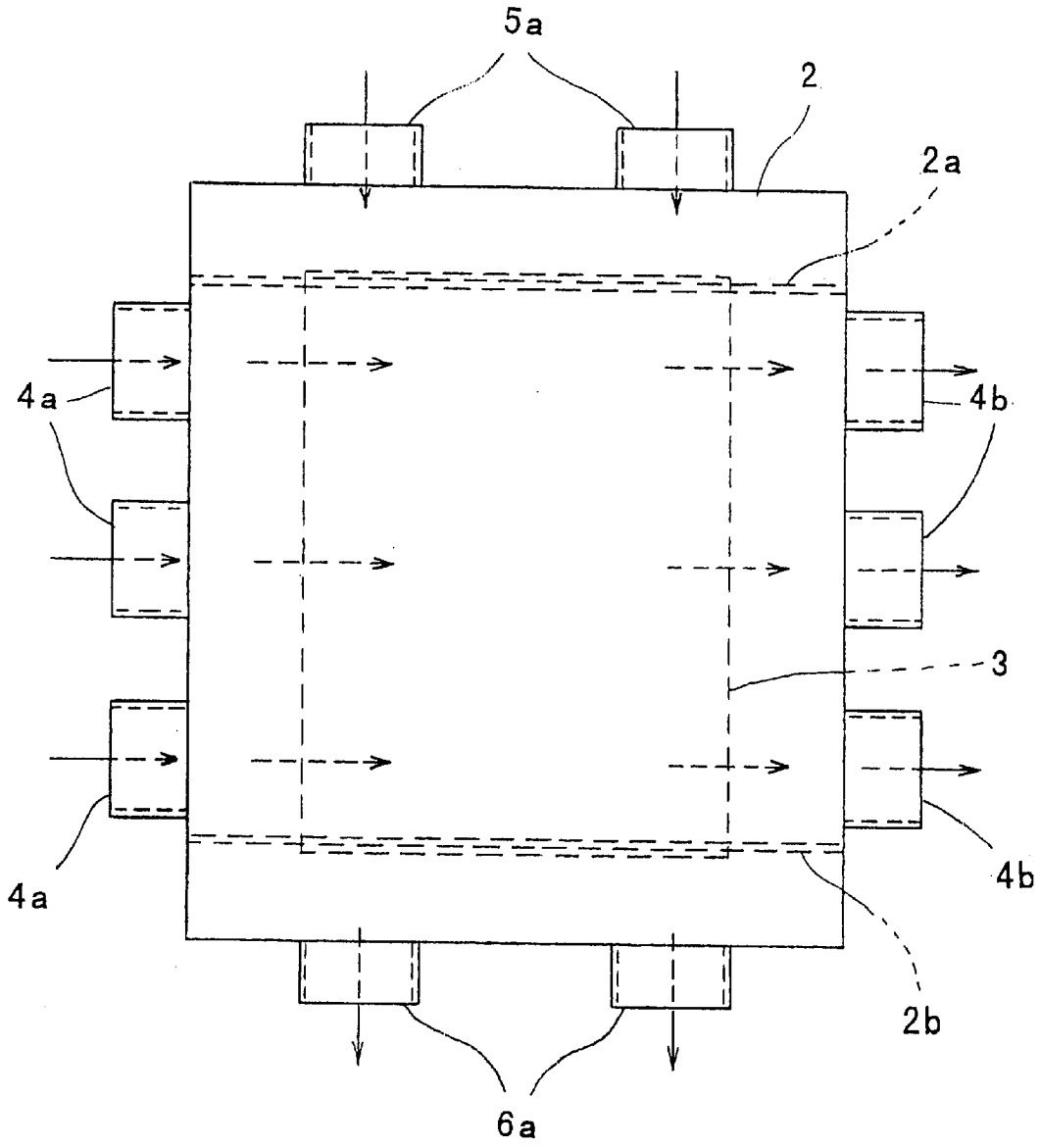
FIG. 5 is a side view illustrating the heat exchanger of further another embodiment of the present invention in its installation state.
Figure 6:
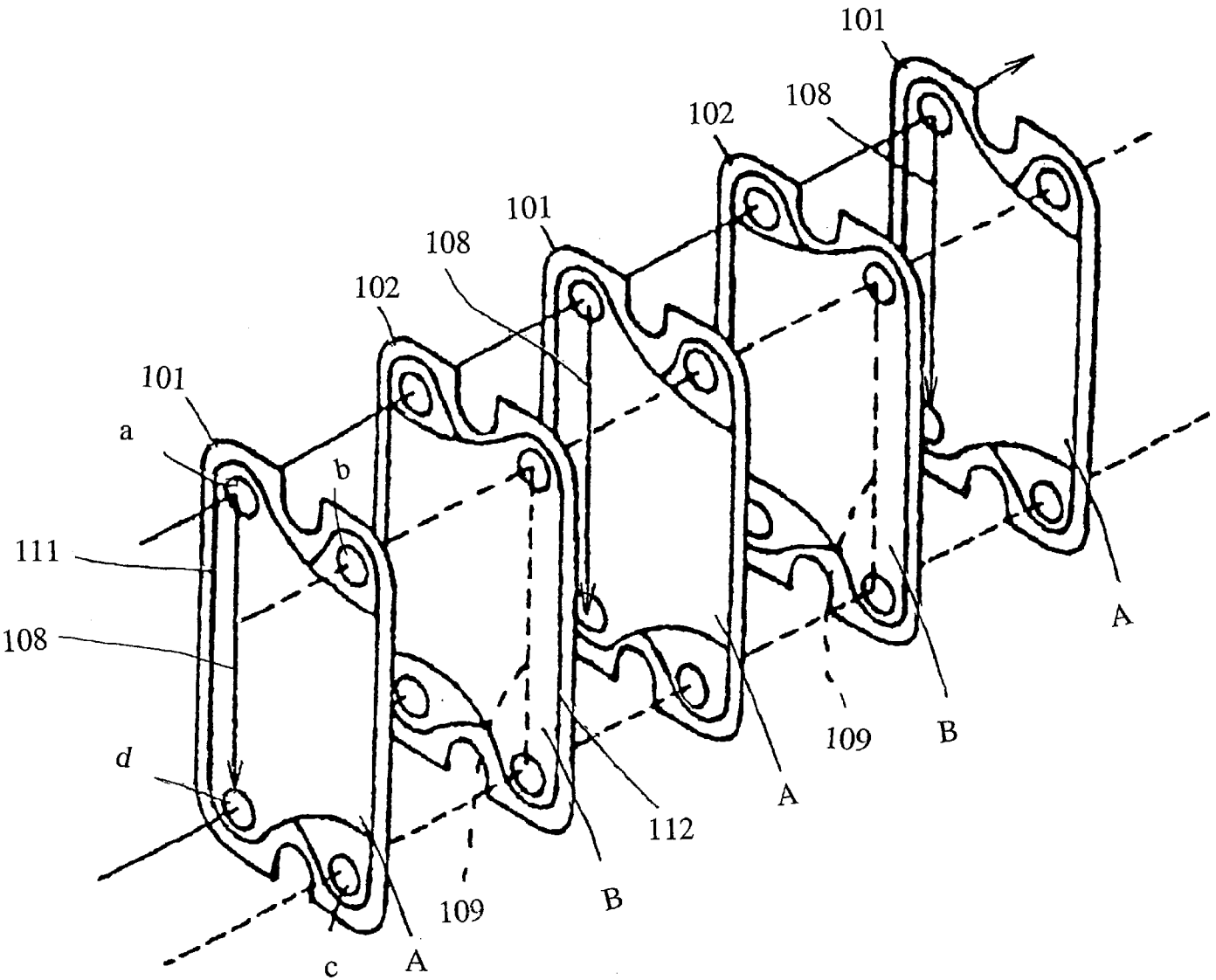
FIG. 6 is an exploded perspective view of the essential part of the conventional heat exchanger.
Figure 7:
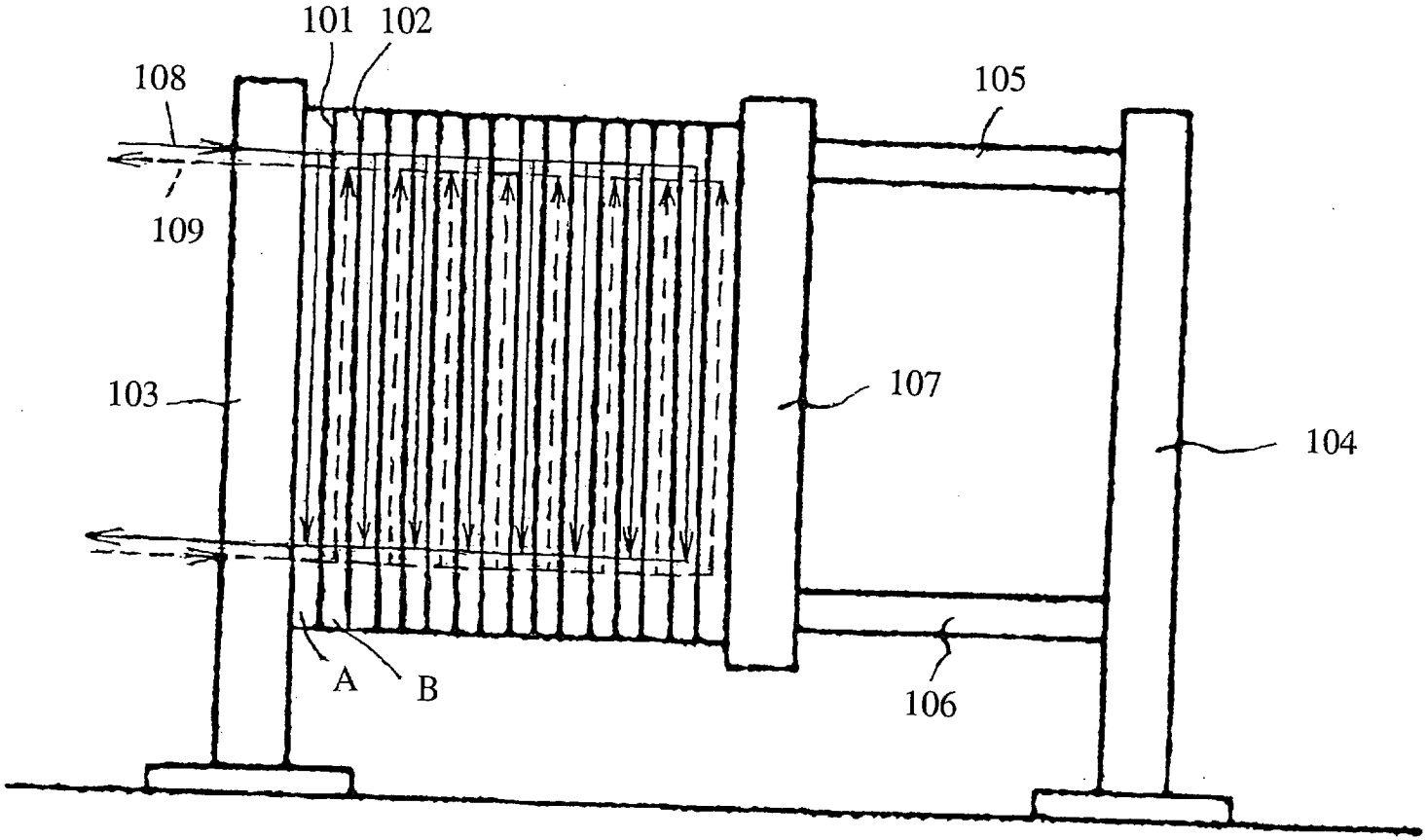
FIG. 7 is a schematic descriptive view of the conventional heat exchanger in its assembling state.

In the heat exchanger of the embodiment of the present invention, the shell 2 has the single upper inlet-outlet opening 5*a,* the single lower inlet-outlet opening 6*a,* the single supply port 4*a* and the single discharge port 4*b.* Each of these components may be formed in the shell 2 in plural numbers, as shown in FIG. 5. In this case, it is possible to cause the working fluid and the heat-exchanger fluid to flow uniformly in each of the tubular heat transferring members 3 and between them in the intermediate zone 4, respectively.

In the heat exchanger of the embodiment of the present invention, there may be provided, in the use of the heat exchanger as the evaporator, a ultrasonic vibrator for vibrating the working fluid by a ultrasonic wave on the upstream side of the lower inlet-outlet opening 6*a* through which the working fluid is supplied to the lower zone 6 in the liquid phase. In this case, the ultrasonic wave generates fine bubbles in the working fluid. When the working fluid including the fine bubbles reaches the tubular heat transferring members 3 from the lower zone 6, the bubbles rise to the surface of the working fluid along the inner surface of the tubular heat transferring members 3 so as to stir the working fluid, which exists in the liquid phase in the vicinity of the inner surface of the tubular heat transferring members 3. It is therefore possible to facilitate an appropriate contact of the working fluid with the inner surface of the tubular heat transferring members 3, thus improving the evaporation efficiency.

According to the present invention as described in detail, the heat exchanger has a structure that the tubular heat transferring members serving as the heat transferring faces for making heat exchange are disposed in the box-shaped shell, any one of the high temperature fluid and the low temperature fluid passes through the inside of the tubular heat transferring members and the other of the high temperature fluid and the low temperature fluid passes through the region surrounding the tubular heat transferring members in a direction perpendicular to the above-mentioned any one of them so that the heat exchange can be made between the high temperature fluid and the low temperature fluid through the tubular heat transferring members. As a result, it is unnecessary to use any packing member in order to ensure the gap between the heat transferring faces. In addition, it is possible to ease restriction in pressure applied to fluid so that the fluid having a high temperature and a high pressure can be used. It is also possible to dispose a large number of heat transferring faces and increase the size thereof so as to improve the heat exchange efficiency. There is no occurrence of leakage at the packing members, thus improving remarkably the reliability and safety. The opposite end portions of the tubular heat transferring members serve as an inlet to the inside of the tubular heat transferring members and an outlet therefrom and there is no opening formed in the intermediate portion of the tubular heat transferring members without wasting material in a blanking process for the tubular heat transferring members. It is therefore possible to provide economic effects and simplify the flow line of the fluid to reduce pressure loss.

When the tubular heat transferring members have the prescribed pattern of irregularity in the present invention, it is possible to ensure a large area of the heat transferring faces. In addition, it is possible to cause evaporation or condensation more effectively when the heat exchanger is used as an evaporator or a condenser.

When the tubular heat transferring members have a porous inner surface so as to increase, in the use of the heat exchanger as the evaporator, bubble generation cores of the fluid, which comes into contact with the inner surface of the tubular heat transferring members to be heated and to facilitate removal of the bubble generation cores, which have grown to a prescribed size, from the inner surface of the tubular heat transferring members, it is possible to facilitate the generation of bubbles so as to cause evaporation more effectively, thus improving the heat exchange efficiency. In addition, when the heat exchanger is used as the condenser, the porous inner surface of the tubular heat transferring members makes it possible to increase the area for the heat exchange, thus improving the condensation efficiency.

What is claimed is:

1. A heat exchanger for making a heat exchange between a high temperature fluid and a low temperature fluid, said heat exchanger comprising:

a shell having a box-shape, an inside of which is divided into at least three zones disposed in a prescribed direction by at least two parallel partition walls; and a plurality of tubular heat transferring members, said heat transferring members comprising a plurality of tubular bodies each having opposite open ends and two surfaces being opposite and in parallel to each other at a prescribed distance, said tubular bodies being disposed in parallel with each other in an intermediate zone, so that a central axis of each of said tubular bodies coincide with a prescribed direction and said surfaces of said tubular bodies are opposite in parallel and in parallel to each other, said tubular bodies passing through said at least two parallel partition walls so that the opposite open end of each said tubular bodies are located in said adjacent zones to said intermediate zone, respectively, and an inside of each of said tubular bodies being isolated from said intermediate zone; heat exchange being made through said tubular heat transferring members serving as heat transferring faces by supplying any one of the high temperature fluid and the low temperature fluid to any one of said adjacent zones to said intermediate zone of said shell under a prescribed pressure, to cause said any one of the high temperature fluid and the low temperature fluid to pass through said tubular heat transferring members, and discharging said any one of the high temperature fluid and the low temperature fluid from the other of said adjacent zones to said intermediate zone, while supplying the other of the high temperature fluid and the low temperature fluid to said intermediate zone from a side surface of said shell to cause it to flow between said tubular heat transferring members in a direction perpendicular to an axial direction of said tubular heat transferring members.

2. The heat exchanger as claimed in claim 1, wherein:

said tubular heat transferring members have on their surfaces a prescribed pattern of irregularity.

3. The apparatus as claimed in claim 1 or 2, wherein:

said tubular heat transferring members have a porous inner surface.

4. A heat exchanger for making a heat exchange between a high temperature fluid and a low temperature fluid, said heat exchanger comprising: a shell having a box-shape, an inside of which is divided into at least three zones disposed in a prescribed direction by at least two parallel partition walls; and a plurality of tubular heat transferring members, said heat transferring members comprising a plurality of tubular bodies each having opposite open ends and two surfaces being opposite and in parallel to each other at a prescribed distance, said tubular bodies being disposed in parallel with each other in an intermediate zone, said tubular bodies passing through said at least two parallel partition walls, and an inside of each of said tubular bodies being isolated from said intermediate zone.

5. The heat exchanger as claimed in claim 4, wherein said tubular heat transferring members have on their surface a prescribed pattern of irregularity, so as to ensure a larger area for a heat transferring face.

6. The heat exchanger as claimed in claim 4, wherein said tubular heat transferring members have a porous inner surface aligned through out the tubular member's interior.

* * * * *